US007211940B2

(12) United States Patent
Ishikawa et al.

(10) Patent No.: US 7,211,940 B2
(45) Date of Patent: May 1, 2007

(54) IMAGE DISPLAY DEVICE WITH OPPOSED SUBSTRATES OF DIFFERENT THICKNESS SEPARATED BY SPACERS

(75) Inventors: Satoshi Ishikawa, Fukaya (JP); Takashi Nishimura, Fukaya (JP); Sachiko Hirahara, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/416,096

(22) Filed: May 3, 2006

(65) Prior Publication Data

US 2006/0192480 A1 Aug. 31, 2006

Related U.S. Application Data

(63) Continuation of application No. PCT/JP2004/016738, filed on Nov. 11, 2004.

(30) Foreign Application Priority Data

Nov. 17, 2003 (JP) ..... 2003-387196

(51) Int. Cl.
*H01J 1/62* (2006.01)

(52) U.S. Cl. ..... 313/292; 313/495

(58) Field of Classification Search ..... 313/495–497, 313/292, 238

See application file for complete search history.

(56) References Cited

FOREIGN PATENT DOCUMENTS

| | | |
|---|---|---|
| JP | 9-283059 | 10/1997 |
| JP | 10-69867 | 3/1998 |
| JP | 2001-272926 | 10/2001 |
| JP | 2003-109528 | 4/2003 |
| JP | 2003-109529 | 4/2003 |
| JP | 2003-216068 | 7/2003 |
| JP | 2003-308798 | 10/2003 |

*Primary Examiner*—Joseph Williams
(74) *Attorney, Agent, or Firm*—Oblon, Spivak, McClelland, Maier & Neustadt, P.C.

(57) ABSTRACT

In a flat image display device in which a first substrate having phosphor layers formed on an inner surface thereof and a second substrate having electron emitting elements which excite the phosphor layers are located opposite each other with a gap therebetween, the plate thickness of the second substrate is made smaller than the plate thickness of the first substrate. The second substrate is formed thinner than the first substrate so that it is more flexible. Even if spacers are subject to variation in height, therefore, the first and second substrates can be securely brought into contact with the spacers, whereby gaps between the spacers and the substrates can be eliminated, and electric discharge between the first and second substrates can be restrained.

3 Claims, 2 Drawing Sheets

IMAGE DISPLAY DEVICE WITH OPPOSED SUBSTRATES OF DIFFERENT THICKNESS SEPARATED BY SPACERS

CROSS REFERENCE TO RELATED APPLICATIONS

This is a Continuation Application of PCT Application No. PCT/JP2004/016738, filed Nov. 11, 2004, which was published under PCT Article 21(2 ) in Japanese.

This application is based upon and claims the benefit of priority from prior Japanese Patent Application No. 2003-387196, filed Nov. 17, 2003, the entire contents of which are incorporated herein by reference.

BACKGROUND OF THE INVENTION

1. Field of the Invention

This invention relates to an image display device provided with opposed substrates and a plurality of spacers located between the substrates.

2. Description of the Related Art

In recent years, various flat image display devices have been noticed as a next generation of lightweight, thin display devices to replace cathode-ray tubes (CRT's). A surface-conduction electron emission device (SED) has been developed as a kind of a field emission device (FED) that serves as a flat display device, for example.

This SED comprises a first substrate and a second substrate that are opposed to each other across a predetermined gap. These substrates have their respective peripheral portions joined together by a rectangular sidewall, thereby constituting a vacuum envelope. Three-color phosphor layers are formed on the inner surface of the first substrate. Arranged on the inner surface of the second substrate are a large number of electron emitting elements for use as electron sources, which correspond to pixels, individually, and excite the phosphor. Each electron emitting element is formed of an electron emitting portion, a pair of electrodes that apply voltage to the electron emitting portion, etc.

For the SED constructed in this manner, it is important to maintain a high degree of vacuum in a space between the first substrate and the second substrate, that is, in the vacuum envelope. If the degree of vacuum is low, the life performance of the electron emitting elements, and hence, the life performance of the device lower inevitably. In order to support an atmospheric load that acts the first and second substrates and maintain the gap between the substrates, in a device described in Jpn. Pat. Appln. KOKAI Publication No. 2001-272926, moreover, a number of plate-shaped or columnar spacers are arranged between the two substrates. In displaying an image, in the SED, an anode voltage is applied to the phosphor layers, and electron beams emitted from the electron emitting elements are accelerated by the anode voltage and collided with the phosphor layers, whereupon the phosphor glows and displays the image. In order to obtain practical display properties, the phosphor used should be one that is similar to that of a conventional cathode-ray tube, and the anode voltage should be set to several kV or more, preferably to 5 kV or more.

In the flat image display device described above, a high voltage of 5 kV or more is applied between a front substrate and a rear substrate, whereby the electron beams emitted from the electron emitting elements on the rear substrate are accelerated and delivered to the phosphor on the front substrate. Since the luminance of the displayed image depends on the accelerated voltage, a high accelerated voltage should preferably be applied. In the case where the high voltage is applied, however, gaps, if any, between the first substrate or the second substrate and the spacers may possibly cause a problem, such as disturbance of the electron beams attributable to electric field concentration or electric discharge in micro gaps. If any electric discharge occurs, the electron emitting elements, a phosphor screen, or a driver circuit may possibly be broken or degraded.

Accordingly, the respective heights of the spacers must be controlled with high accuracy such that errors are 1 μm or less, to eliminate the gaps. Since a number of spacers are provided between the first substrate and the second substrate, however, it is technically difficult to make the heights of all the spacers uniform, so that the manufacturing cost is high.

BRIEF SUMMARY OF THE INVENTION

This invention is made in consideration of these circumstances, and its object is to provide an image display device in which generation of electric discharge is restrained to ensure improved reliability and display quality.

In order to achieve the object, an image display device according to an aspect of the invention comprises: a first substrate having phosphor layers formed on an inner surface thereof; a second substrate located opposite the first substrate with a gap and provided with phosphor exciting means which excites the phosphor layers; and a plurality of spacers which are arranged between the first substrate and the second substrate and support an atmospheric load exerted on the first substrate and the second substrate, the plate thickness of the second substrate being smaller than the plate thickness of the first substrate.

DETAILED DESCRIPTION OF THE INVENTION

Embodiments in which this invention is applied to an SED, a kind of an FED, for use as a flat image display device will now be described in detail with reference to the drawings.

Figure 1:
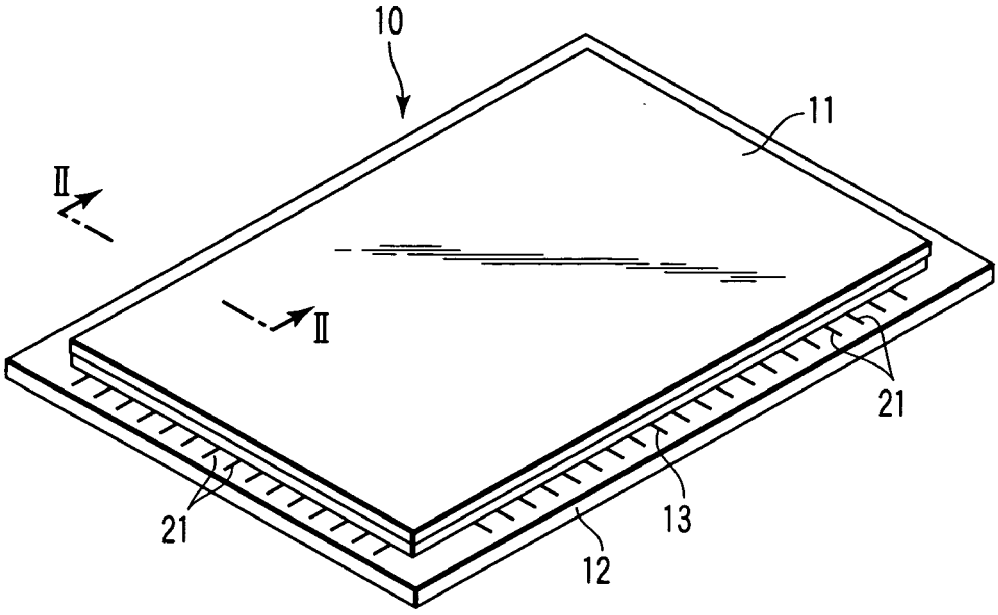
FIG. 1 is a perspective view showing an SED according to a first embodiment of this invention.
Figure 2:
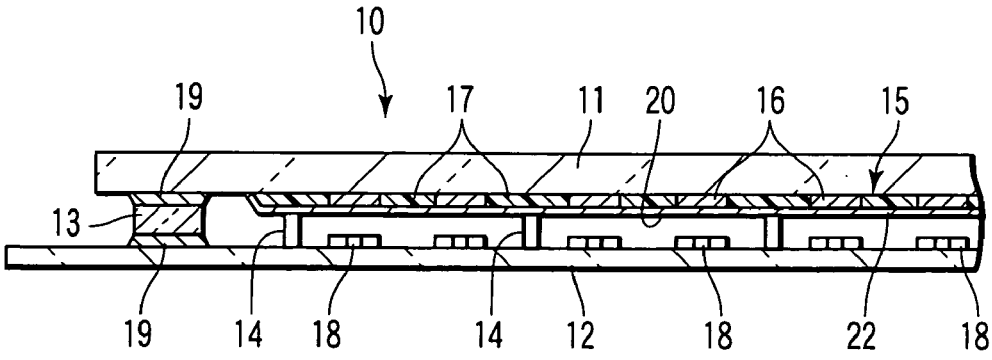
FIG. 2 is a sectional view of the SED taken along line II—II of FIG. 1.

As shown in FIGS. 1 and 2, the SED comprises a first substrate 11 and a second substrate 12 as insulating substrates, which are formed of a rectangular glass plate each. These substrates are located opposite each other with a gap of 1 to 2 mm between them. The first substrate 11 and the second substrate 12 have their respective peripheral edge portions joined together by a sidewall 13 of glass in the form of a rectangular frame, thereby forming a flat, rectangular vacuum envelope 10 of which the interior is kept at a high vacuum of about $10^{-4}$ Pa or less. The sidewall 13 that functions as a frame is formed of a sealing material 19, such as fritted glass based on low-melting glass or low-melting metal, and is sealed to the peripheral edge portion of the second substrate 12 and the peripheral edge portion of the first substrate 11.

The plane dimensions of the second substrate 12 are larger than the plane dimensions of the first substrate 11. Further, the plate thickness of the second substrate 12 is smaller than the plate thickness of the first substrate 11, accounting for 80% or less of the thickness of the first substrate, preferably 50% or less. For example, the first substrate 11 is formed having a plate thickness of 2.8 mm, while the second substrate 12 is formed having a plate thickness of 1.1 mm.

An image display region on the inner surface of the first substrate 11 is formed with a phosphor screen 15 as a fluorescent screen, which has red, green, and blue phosphor layers 16 and a matrix-shaped light shielding layer 17. These phosphor layers 16 are formed in the shape of stripes or dots. A metal back 20, such as an aluminum film, is formed on the phosphor screen 15, and moreover, a getter film 22 is formed overlapping the metal back.

Formed on the inner surface of the second substrate 12 are a number of electron emitting elements 18, which individually emit electron beams as phosphor exciting means for exciting the phosphor layers 16 of the phosphor screen 15. The electron emitting elements 18 are arranged in a plurality of columns and a plurality of rows corresponding to individual pixels. Each electron emitting element 18 is formed of an electron emitting portion (not shown), a pair of element electrodes for applying voltage to the electron emitting portion. Provided on the inner surface of the second substrate 12 are a large number of wires 21 in a matrix, such as scanning wires for supplying potential to the electron emitting elements 18, modulation wires, etc. End portions of these wires are led out of the vacuum envelope 10.

In the vacuum envelope 10, a plurality of columnar spacers 14 are arranged between the first substrate 11 and the second substrate 12. Each spacer 14 is set up substantially at right angles to the first and second substrates 11 and 12. One end of each spacer 14 abuts against the first substrate 11 through the getter film 22, metal back 20, and light shielding layer 17 of the phosphor screen 15, while the other end abuts against the second substrate 12. By abutting against the respective inner surfaces of the first substrate 10 and the second substrate 12, the spacers 14 support an atmospheric load that acts on the first and second substrates 11 and 12 and keep the space between the substrates at a given value. Plate-shaped spacers may alternatively be used as the spacers 14.

Figure 3:
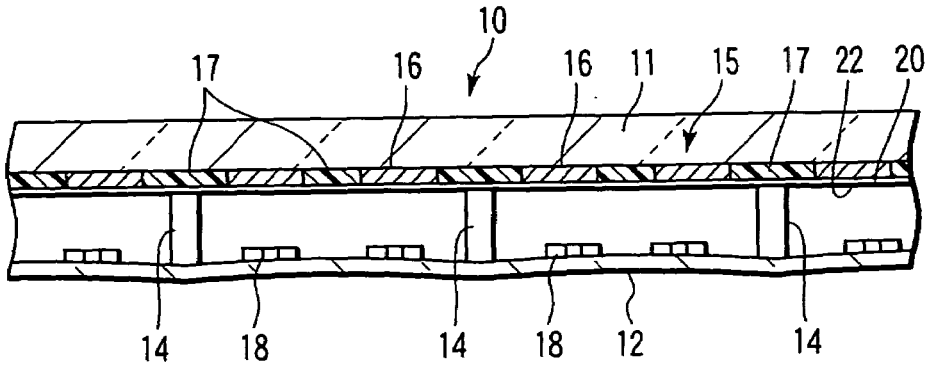
FIG. 3 is a sectional view typically showing the SED.

As mentioned before, the second substrate 12 is formed thinner than the first substrate 11, and the vacuum envelope 10 is exhausted to a high vacuum. As typically shown in FIG. 3, the second substrate 12 is slightly bent toward the first substrate 11 and the spacers 14 and kept in a state such that it abuts against the respective other ends of the spacers 14 without any gaps.

In displaying an image in the SED constructed in this manner, an anode voltage is applied to the phosphor screen 15 and the metal back 20, and electron beams emitted from the electron emitting elements 18 are accelerated by the anode voltage and collided with the phosphor screen. Thus, the phosphor layers 16 of the phosphor screen 15 are excited to glow and display a color image.

According to the SED constructed in this manner, the second substrate 12 is made thinner than the first substrate 11 so that it is more flexible. Even if the spacers 14 are subject to variation in height, therefore, the slight bending of the second substrate 12 enables the first and second substrates 11 and 12 to touch the spacers securely, thereby eliminating gaps between the spacers and the substrates. Thus, electric discharge generated between the first substrate 11 and the second substrate 12 can be restrained, whereby reliability can be improved. Since the first substrate 11 is made thicker than the second substrate 12, the first substrate 11 is kept flat without bending, so that distortion of the displayed image can be prevented. Thus, there may be obtained the SED with improved reliability and display quality.

If the reduction of the second substrate 12 in thickness causes anxiety about strength, high-strength glass or a metal plate entirely covered by an insulating layer may be used for the second substrate 12.

If the second substrate 12 is thinned, the strength of the vacuum envelope lowers correspondingly. Since the second substrate 12 on the rear side is covered and protected by a cabinet or case (not shown), however, it cannot be broken by any external factor. In order to prevent the first substrate 11 on the front side from being broken, and moreover, to enhance safety, high-strength glass or a metal plate entirely covered by an insulating layer may be used for the second substrate 12. If the high-strength glass is used for the second substrate 12, its shear failure strength, compression failure strength, and/or tensile failure strength can be made higher than that of the first substrate 11.

Figure 4:
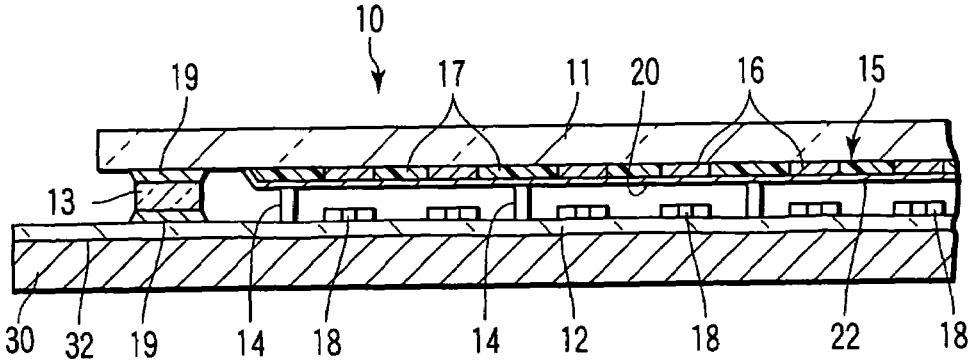
FIG. 4 is a sectional view showing an SED according to a second embodiment of this invention.
Figure 5:
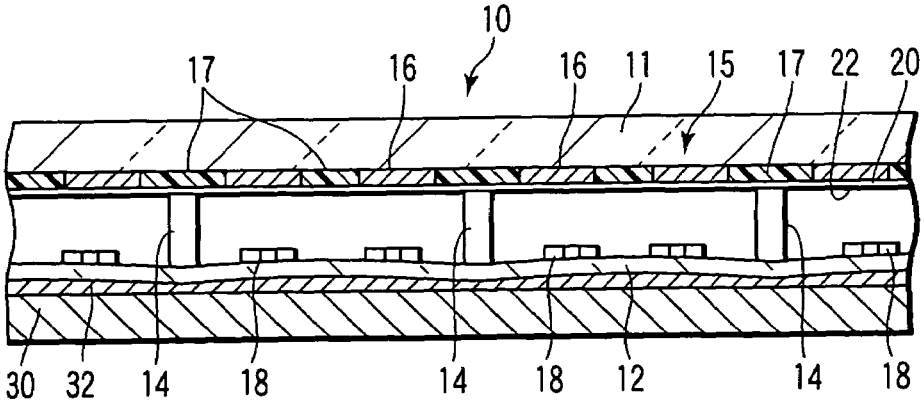
FIG. 5 is a sectional view typically showing the SED according to the second embodiment.

As in a second embodiment shown in FIGS. 4 and 5, a reinforcement member 30 may be attached to the outer surface of the second substrate 12 so that the overall strength of the second substrate and the vacuum envelope 10 is enhanced. In this case, for example, a metal plate of aluminum is used for the reinforcement member 30. This metal plate is formed as a rectangular structure that has substantially the same external dimensions as those of the second substrate 12 and a plate thickness of about 5 mm. The reinforcement member 30 is pasted on the outer surface of the second substrate 12 with an adhesive 32, thereby covering the entire outer surface of the second substrate. Even if the second substrate 12 is slightly bent, the adhesive 32 can fill a gap between the outer surface of the second substrate and the reinforcement member 30, thereby securely joining the second substrate and the reinforcement member together without any gap. Since the reinforcement member 30 is provided on the outer surface of the second substrate 12, that is, the reverse surface of the vacuum envelope 10, it never influences the screen display.

The reinforcement member is not limited to a metal plate, but may be formed of a solid or hollow rod material, square bar, frame, or the like.

The following is a description of a plurality of examples.

EXAMPLE 1

First, a first substrate formed of a black matrix, phosphor layers, an aluminum layer, etc. on a glass plate of 850 mm×550 mm×2.8 mm (plate thickness) and a second substrate formed of scanning wires, modulation wires, element electrodes, etc. on a glass plate of 900 mm×600 mm×1.1 mm (plate thickness) were prepared. Pixels were arranged at pitches of 0.6 mm.

Then, columnar spacers of 0.2-mm diameter and 1.5-mm height were arranged at intervals of 6 mm in a lattice on the second substrate. Subsequently, the first substrate and the second substrate were sealed together in a vacuum, whereupon an SED(A) was fabricated.

For the sake of comparison, a first substrate and a second substrate were formed from a glass plate of 2.8-mm plate thickness each, and an SED(B) was prepared having columnar spacers arranged in the same manner as those of the aforementioned vacuum panel A.

When electron beam paths near the spacers were investigated for the SED(A) and the SED(B), the SED(A) was found to suffer less disturbance of electron beams and produce better results from image quality evaluation of the visual impression level. Further, their frequencies of electric discharge were compared with a voltage of 12 kV applied to the first substrate and maintained for one hour. In consequence, the frequencies of electric discharge for the SED(B) and SED(A) were 3.6 and 1.2, respectively, on the average, thus indicating a substantial improvement.

When a pressure strength test was conducted using high-pressure air, the second substrates of ⅓ of SED(A)'s were found to be broken at 4.5 atm. No substrates of SED(B)'s were broken at pressures not higher than 5 atm. Thereupon, the same pressure strength test as aforesaid was conducted with an aluminum square tube of 3-mm wall thickness and 30-mm outside diameter attached to the second substrate with a self-curing adhesive. In consequence, no substrates were broken at all at pressures not higher than 5 atm.

EXAMPLE 2

First, a first substrate formed of a black matrix, phosphor layers, an aluminum layer, etc. on a glass plate of 850 mm×550 mm×2.8 mm (plate thickness) was prepared. Further, a second substrate was prepared by coating the whole structure of a 48% Fe—Ni plate material of 0.25-mm plate thickness with an insulating substance that consists mainly of glass or the like, e.g., an insulating layer of Li-based alkali-borosilicate glass. A spray method was used as a coating method. Furthermore, scanning wires, modulation wires, element electrodes, etc. were formed on the electron emitting element forming surface side of the second substrate after an $SiO_2$ film was formed thereon by sputtering. Thereafter, the first substrate and the second substrate were sealed together in the same manner as in Example 1, whereupon an SED(C) was fabricated.

When electron beam paths near spacers were investigated in the same manner as aforesaid, the SED(C), compared with the SED(B), was found to suffer less disturbance of electron beams and produce better display images based on image quality evaluation of the visual impression level. Further, their frequencies of electric discharge were compared with a voltage of 12 kV applied to the first substrate and maintained for one hour. In consequence, the frequencies of electric discharge for the SED(B) and SED(C) were 3.6 and 0.9, respectively, on the average, thus indicating a substantial improvement. When a pressure strength test was conducted using high-pressure air, moreover, no substrates of SED(C)'s were broken at all at pressures not higher than 5 atm, thus indicating a good result.

The present invention is not limited directly to the embodiments described above, and its components may be embodied in modified forms without departing from the spirit of the invention. Further, various inventions may be formed by suitably combining a plurality of components described in connection with the foregoing embodiments. For example, some of the components according to the foregoing embodiments may be omitted. Furthermore, components according to different embodiments may be combined as required.

The diameter and height of the spacers and the dimensions, materials, etc. of the other components are not limited to the foregoing embodiments, but may be suitably selected as required. This invention is not limited to image display devices that use surface-conduction electron emitting elements as phosphor layer exciting means, but may alternatively be applied to image display devices that use other electron sources, such as the field-emission type, carbon nanotubes.

What is claimed is:

1. An image display device comprising:

a first substrate having phosphor layers formed on an inner surface thereof;

a second substrate composed mainly of glass, located opposite the first substrate with a gap and provided with phosphor exciting elements which excite the phosphor layers;

a plurality of spacers which are arranged between the first substrate and the second substrate and support an atmospheric load exerted on the first substrate and the second substrate; and a reinforcement member formed of a metal plate and pasted on an outer surface of the second substrate with an adhesive, the plate thickness of the second substrate being smaller than the plate thickness of the first substrate, the second substrate being slightly bended at positions of the spacers and abutting the spacers without gap, the adhesive filling a gap between the outer surface of the second substrate and the reinforcement member.

2. The image display device according to claim 1, wherein the first substrate is composed mainly of glass.

3. The image display device according to claim 1, wherein the plate thickness of the second substrate is 80% or less of the plate thickness of the first substrate.

* * * * *